United States Patent [19]

Förster et al.

[11] 4,435,106

[45] Mar. 6, 1984

[54] DIRECTING-BARRIER FOR A ROADWAY

[76] Inventors: Günther Förster, Neuen Bäue 27, D-6300 Giessen; German Gresser, Schönleinstrasse 3, D-8700 Würzburg, both of Fed. Rep. of Germany

[21] Appl. No.: 349,558

[22] Filed: Feb. 17, 1982

[30] Foreign Application Priority Data

Feb. 19, 1981 [DE] Fed. Rep. of Germany ..... 3106047

[51] Int. Cl.[3] ..... E01F 15/00

[52] U.S. Cl. ..... 404/6; 256/13.1

[58] Field of Search ..... 404/6, 7, 9, 8; 256/13.1

[56] References Cited

U.S. PATENT DOCUMENTS

| | | | |
|---|---|---|---|
| 1,606,588 | 11/1926 | Meermans | 256/13.1 X |
| 1,927,189 | 9/1933 | Sory | 256/13.1 X |
| 2,994,255 | 8/1961 | Trief | 404/7 |
| 3,326,099 | 6/1967 | Cova | 404/7 |
| 3,448,963 | 6/1969 | Gravisse | 256/13.1 |
| 3,678,815 | 7/1972 | Yonker | 256/13.1 X |
| 3,807,699 | 4/1974 | France | 404/6 X |
| 4,105,353 | 8/1978 | Bork | 404/6 X |
| 4,307,973 | 12/1981 | Glaesener | 404/6 |
| 4,348,133 | 9/1982 | Trent | 404/6 |
| 4,358,090 | 11/1982 | Glaesener | 404/6 X |

FOREIGN PATENT DOCUMENTS

| | | | |
|---|---|---|---|
| 1459822 | 10/1969 | Fed. Rep. of Germany | 404/6 |

*Primary Examiner*—Ernest R. Purser

*Attorney, Agent, or Firm*—Flynn, Thiel, Boutell & Tanis

[57] ABSTRACT

A directing barrier for a roadway has a driving surface which rises from the roadway edge outwardly first gently and then more strongly and then spaced below an overhanging guiding mechanism. A steep, convex rise follows the gentle rise and transfers under the guiding mechanism into a flattened area.

10 Claims, 4 Drawing Figures

DIRECTING-BARRIER FOR A ROADWAY

DESCRIPTION

FIELD OF THE INVENTION

This invention relates to a directing barrier for a roadway and, more particularly, to a directing barrier having a driving surface which rises from the roadway edge outwardly first gently, then more strongly and then spaced below an overhanging guidind mechanism.

BACKGROUND OF THE INVENTION

In a conventional directing barrier of this type (German OS No. 27 53 918, U.S. Pat. No. 2,994,255), the strongly rising area of the driving surface extends in a concave shape under the guiding mechanism. In this directing barrier, a disproportionately large amount of the horizontally outwardly directed energy of a vehicle which has left the correct traveling direction is absorbed by the guiding mechanism, which has a braking function. When the tire of the vehicle has run up the more strongly rising area, then it engages the driving surface only with a narrow strip area at the transition between its running surface and its side wall. To the extent that the outwardly directed energy of the vehicle is not emitted by the vehicle to the guiding mechanism, the mentioned narrow strip area of the tire must emit it to the driving surface, which in particular is the case when the vehicle has not as yet had any contact with the guiding mechanism. When the tire has run up on and is traveling along the directing barrier, only the narrow strip area of the running surface is used at all times, which is associated with rapid wear of the tire.

SUMMARY OF THE INVENTION

A purpose of the invention is to provide a directing barrier of the abovementioned type in which, during running of the tire, the outwardly directed energy of the vehicle is absorbed in an improved manner and, particularly in the run-up condition, the tire is less seriously loaded and worn. An inventive directing barrier which attains this purpose is characterized by a steep, convex rise following the gentle rise, which steep, convex rise transfers under the guiding mechanism into a flattened area. The flattened area, as a rule, transfers into a concave area, the transition area from convex to concave providing an almost complete bearing surface for the tire.

When the tire of a motor vehicle drives onto the inventive directing barrier, the gently rising area, as known, has a backsteering effect which is particularly noticeable during slow travel and a very acute drive-on angle. When the tire comes to the steep, convex rise, it drives in effect onto a hump, instead of driving up on a concave shape, wihch strongly reduces the load on the tire. When, due to the steep convex rise, the outwardly directed energy of the vehicle is substantially consumed, then the tire travels with a relatively wide strip of its running surface on the flattened area of the driving surface of the directing barrier. The tire is directed parallel to the roadway by the hump and travels on top of it parallel to the guiding mechanism. Then, the vehicle is gently guided back onto the roadway. At the same time, the engagement of the tires and the directing barrier effects a speed reduction and prevents tilting of the vehicle.

It is particularly purposeful and advantageous if the gentle rise has a rise angel relative to a horizontal reference of from 5° to 25°, preferably approximately 10°; if the steep, convex rise has a maximum rise angle relative to a horizontal reference of from 60° to 80°, preferably approximately 70°; and/or if the flattened area has a rise angle relative to a horizontal reference from 20° to 45°, preferably approximately 30°. These angle ranges for the various rising areas of the directing barrier result in an optimum effect on a tire which drives thereon, particularly if the driving on takes place at an angle greater than 30° with respect to the direction of the roadway. The rise angle increases at the flattened area advantageously progressively convex up to approximately 110° under the guiding mechanism.

The height of the flattened area above a horizontal reference, namely above the roadway, is determined by the wheel base of typical motor vehicles. When one wheel of a pair of wheels has run up onto the directing barrier, the wheel axis should be inclined, preferably at an angle of 10° to 30° relative to the horizontal reference.

It is furthermore particularly purposeful and advantageous if the height of the gentle rise is less than the height of the steep, convex rise and is also less than the height of the flattened rise, and/or if the height of the steep, convex rise is greater than the sum of the heights of the gentle rise nd the height of the flattened rise. These dimensional relationships result in a directing barrier which best meets the above-described purpose.

It is further particularly advantageous and purposeful if the guiding mechanism is an elastic baffle hose. Such a baffle hose is protective for the vehicle and can be provided in place of a steel guide plank since, due to the inventive rise profile of the directing barrier, the outwardly directed energy is absorbed primarily by the rise and needs to be absorbed only to a reduced degree by the guiding mechanism.

It is particularly purposeful and advantageous if the widths of the gentle rise, of the steep, convex rise and of the flattened rise are together not greater than 1.50 meters, and preferably not greater than 1.20 meters. These two relationships are determined by the dimensions of conventional vehicle tires and are optimal for these vehicle tires.

It is also particularly purposeful and advantageous if the width of the gentle rise equals or is less than the width of the remainder of the directing barrier. Such a narrow directing barrier can easily be used, because of the inventive rise profile of the driving surface.

DETAILED DESCRIPTION

Figure 1:
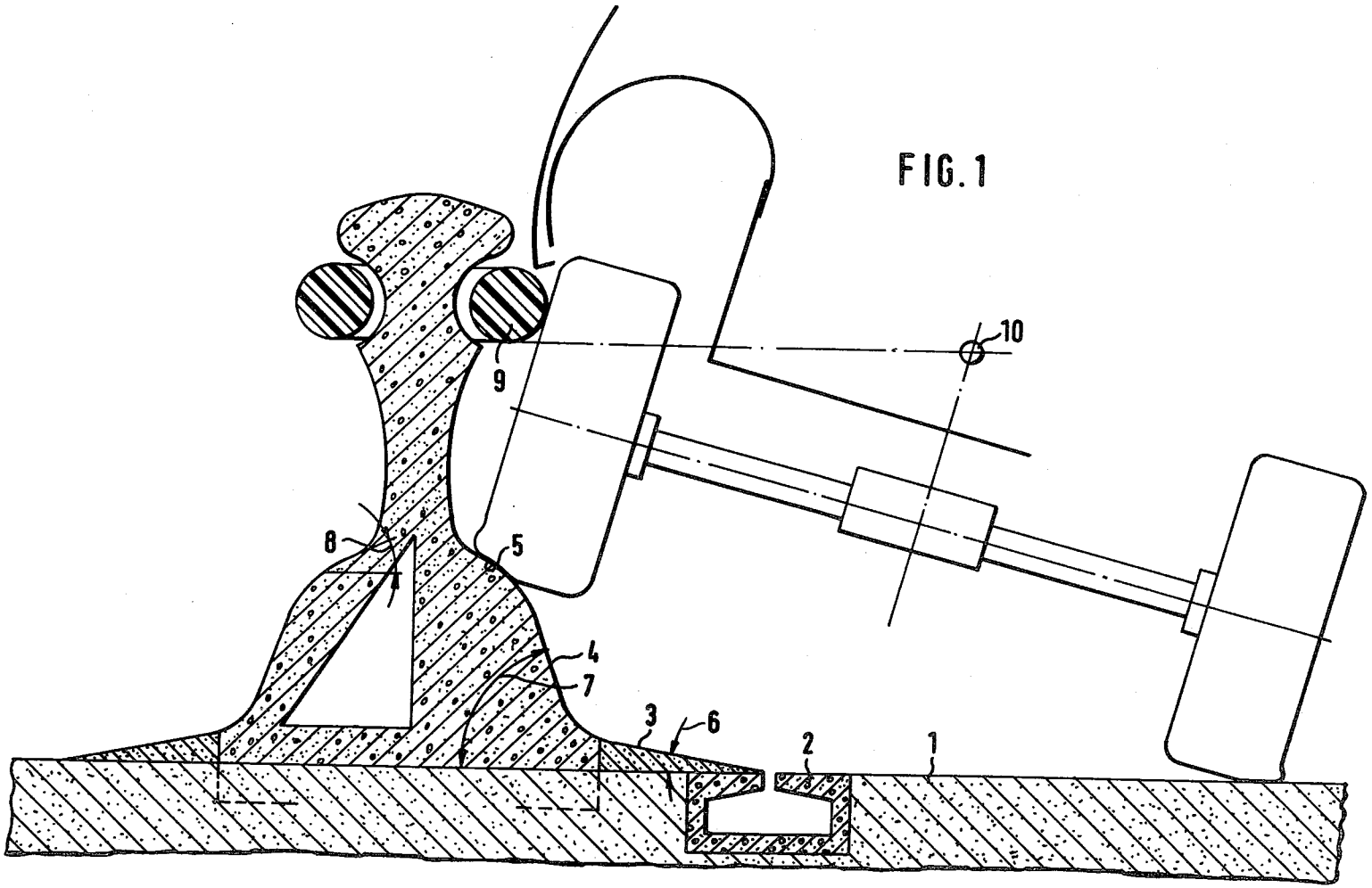
FIG. 1 is a fragmentary sectional view taken along the line I—I in FIG. 1A and shows a roadway and a double directing roadway barrier which embodies the present invention.
Figure 1A:
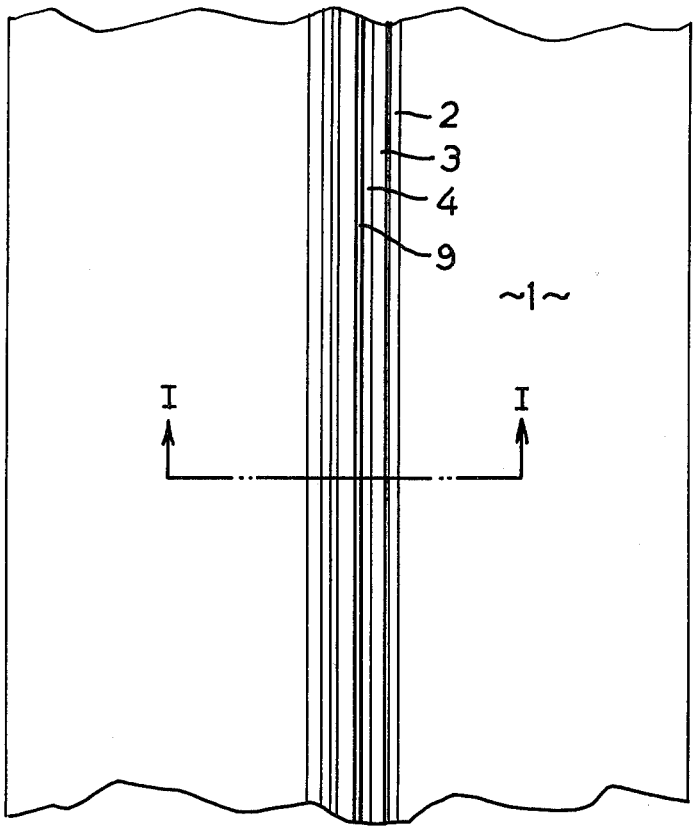
FIG. 1A is a top view of the roadway and directing barrier of FIG. 1.

A double directing safety barrier according to FIG. 1 serves the separation of two oppositely directed roadways. Only the right half of the illustrated double directing barrier will be described hereinafter, as the left half is substantially a mirror-image thereof. The directing barrier can be cast or manufactured at the place of its use, or can be made of prefabricated parts. It is positioned at the edge of a roadway 1 and a drainage trough 2 is provided at the transition between the roadway and the directing barrier.

The directing barrier has a driving surface which includes a gently rising area 3, a steeply rising area 4 and a flattened rising area 5. The gently rising area 3 extends at a relatively small acute angle 6, the steeply rising area 4 at a relatively large acute angle 7 and the flattened rising area 5 at a relatively small acute angle 8 with respect to a horizontal reference. The width of the gently rising area 3 is approximately the same as the width of the remainder of that half of the illustrated double directing barrier. The height or vertical rise of the steeply rising area is preferably 35 to 55 cm and the height of the gently rising area is approximately 20 to 25% of the height of the steeply rising area.

Spaced above the flattened rising area 5 by a distance which is greater than the radius of a common motor vehicle wheel is an elastic guiding mechanism 9 in the form of a baffle hose or polyurethane. The guiding mechanism 9 is located approximately at the height of the center of gravity 10 of a motor vehicle which has been driven onto the directing barrier. The driven-up wheel runs with a narrow strip at the edge of its running surface on the flattened area 5 and the axis of the vehicle wheels is inclined at an acute angle with respect to a horizontal reference.

Figure 2:
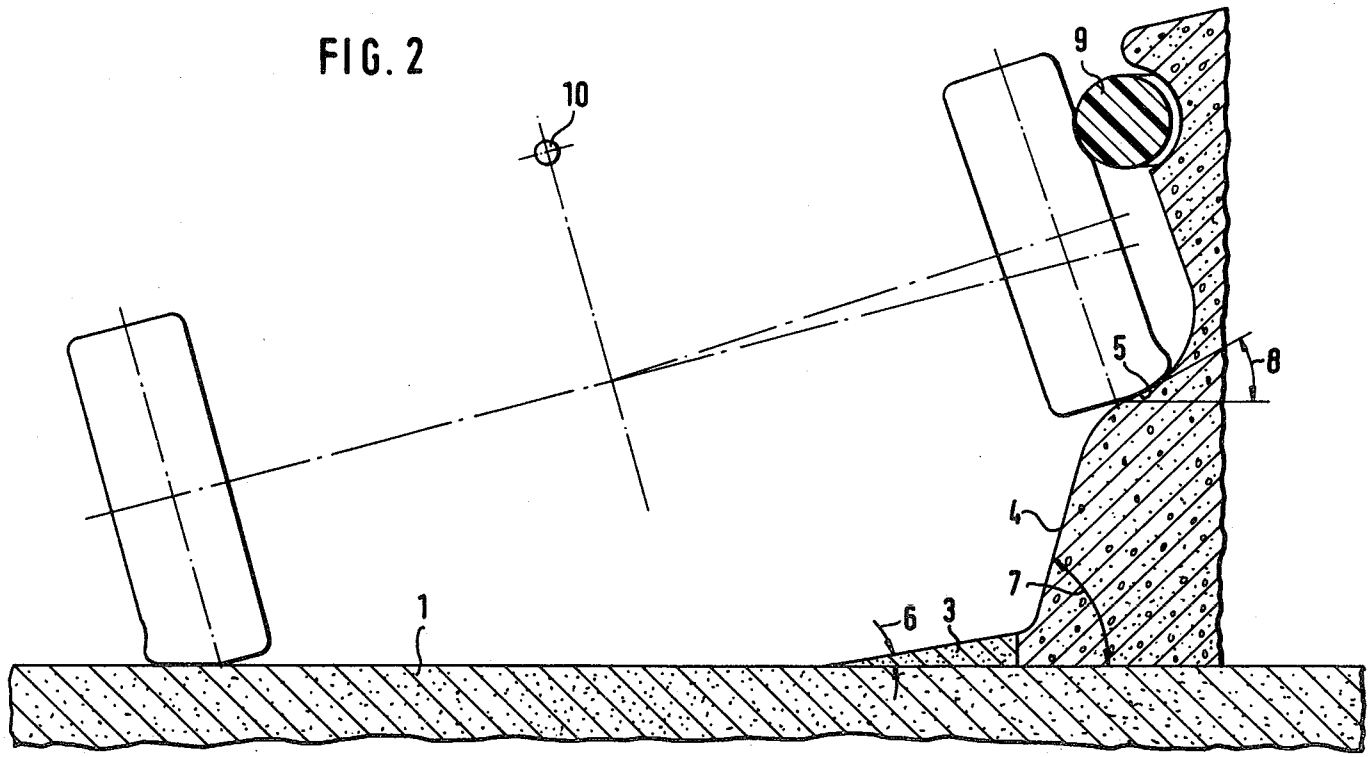
FIG. 2 is a fragmentary sectional view similar to FIG. 1 showing an alternative embodiment of the directing barrier of FIG. 1.
Figure 3:
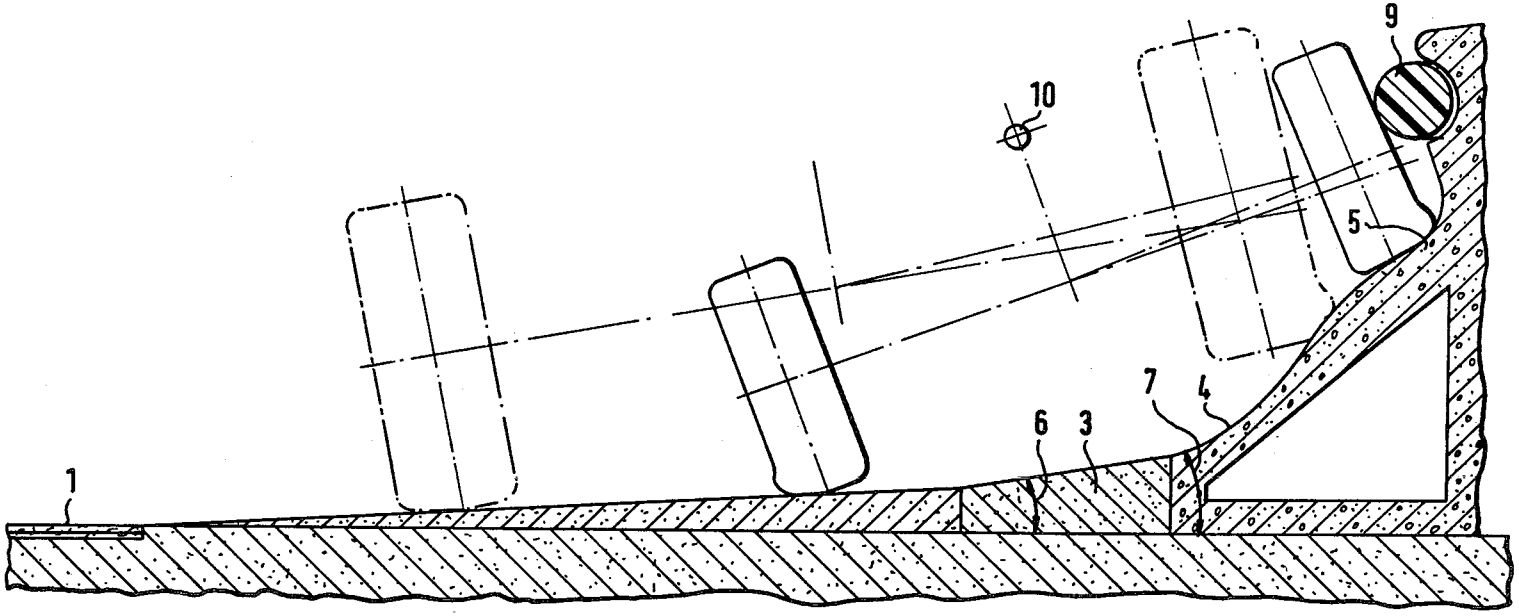
FIG. 3 is a fragmentary sectional view similar to FIG. 1 showing a further alternative embodiment of the directing barrier of FIG. 1.

The directing barriers according to FIGS. 2 and 3 are, in principle, designed like that according to FIG. 1. However, the rise profile is varied within the scope of the invention, FIG. 2 illustrating an extremely steep slope and FIG. 3 an extremely gentle slope. The most practical design lies somewhere near or preferably between these two extremes.

We claim:

1. In a safety barrier adapted to be placed adjacent a roadway having an upper surface, said safety barrier having means defining a driving surface thereon which extends generally upwardly and outwardly from a lateral edge of said roadway surface and includes a first portion which is adjacent said lateral edge of said roadway surface and rises gently, and wherein said saftey barrier has a guide portion spaced vertically above and overhanging at least part of said driving surface, the improvement comprising wherein said driving surface includes second and third portions in addition to said first portion, said second portion being between and contiguous with said first and third portions and merging smoothly therewith, wherein said second portion of said driving surface rises steeply and includes a generally concave region followed by a generally convex region, wherein said third portion of said driving surface is approximately flat and rises gently, and wherein said guide portion overhangs said third portion of said driving surface.

2. The barrier according to claim 1, wherein said guide portion is spaced above said third portion of said driving surface by a distance which is greater than the radius of a motor vehicle wheel.

3. The barrier according to claim 1, wherein said first portion of said driving surface has a rise angle relative to said roadway surface in the range of 5° to 25°.

4. The barrier according to claim 1, wherein said steeply rising second portion of said driving surface has a maximum rise angle relative to said roadway surface in the range of 60° to 80°.

5. The barrier according to claim 1, wherein said third portion of said driving surface has a rise angle relative to said roadway surface in the range of 20° to 45°.

6. The barrier according to claim 1, wherein said first portion of said driving surface has a height which is less than that of said second portion of said driving surface and is less than that of said third portion of said driving surface.

7. The barrier according to claim 1 or claim 6, wherein said first, second and third portions of said driving surface each have a height, and wherein said height of said second portion is greater than a sum of said heights of said first and third portions.

8. The barrier according to claim 1, wherein said guide portion includes an elastic baffle hose.

9. The barrier according to claim 1, wherein said first, second and third portions of said driving surface have a combined width which is less than 1.50 meters.

10. The directing barrier according to claim 1 or claim 9, wherein said first, second and third portions of said driving surface each have a width, and wherein said width of said first portion of said driving surface is less than or equal to a sum of said widths of said second and third portions of said driving surface.

* * * * *